US006841962B2

(12) United States Patent
O'Connor et al.

(10) Patent No.: US 6,841,962 B2
(45) Date of Patent: Jan. 11, 2005

(54) RECIPROCATING LINEAR ACTUATOR

(75) Inventors: Kevin N. O'Connor, Belchertown, MA (US); John N. Bernet, Palmer, MA (US)

(73) Assignee: Package Machinery Co. Inc., W. Springfield, MA (US)

( * ) Notice: Subject to any disclaimer, the term of this patent is extended or adjusted under 35 U.S.C. 154(b) by 136 days.

(21) Appl. No.: 10/227,069

(22) Filed: Aug. 23, 2002

(65) Prior Publication Data

US 2003/0042862 A1 Mar. 6, 2003

Related U.S. Application Data

(60) Provisional application No. 60/316,199, filed on Aug. 31, 2001.

(51) Int. Cl.[7] ..... G05G 5/05

(52) U.S. Cl. ..... 318/565; 318/602; 318/626

(58) Field of Search ..... 318/565, 602, 318/626, 41, 45, 119, 135, 686, 687; 388/909

(56) References Cited

U.S. PATENT DOCUMENTS

| | | | | |
|---|---|---|---|---|
| 3,243,033 A | | 3/1966 | Merchant et al. | |
| 3,635,390 A | * | 1/1972 | Gross | 228/8 |
| 4,110,675 A | | 8/1978 | Wisner | |
| 4,157,489 A | | 6/1979 | Tal | |
| 4,168,458 A | * | 9/1979 | Bouwman | 318/603 |
| 4,175,248 A | * | 11/1979 | Whitfield et al. | 318/467 |
| 4,468,986 A | | 9/1984 | Foret | |
| 4,513,737 A | * | 4/1985 | Mabuchi | 601/101 |
| 4,576,064 A | * | 3/1986 | Kentfield | 74/833 |
| 4,783,627 A | | 11/1988 | Pagel et al. | |
| 4,971,522 A | * | 11/1990 | Butlin | 417/18 |
| 6,253,460 B1 | | 7/2001 | Schmitz | |

* cited by examiner

*Primary Examiner*—Bentsu Ro
(74) *Attorney, Agent, or Firm*—John J. Lee

(57) ABSTRACT

A digitally indexed reciprocating linear actuator includes a frame and a servomotor mounted to the frame. A crank is gear-coupled with integer gear ratio to the servomotor for unidirectional rotation. An actuator slide with a non-home index point is slideably-mounted to the frame for linear motion. A connecting rod couples the crank to the actuator slide. The actuator also includes means, including a sensor, for detecting the index point at two angular positions of the crank. A wrapping machine for wrapping a plurality of articles has repeated cycles of article-handling operations and a plurality of carriages, each carriage capable of moving at least one article for wrapping. The wrapping machine includes at least one digitally indexed reciprocating linear actuator having a crank, and an actuator slide with a non-home index point. The wrapping machine records first and second servomotor angular positions on detecting the index point at first and second angular positions of the crank. The wrapping machine identifies home position as an angular position midway between the first and second positions.

18 Claims, 7 Drawing Sheets

RECIPROCATING LINEAR ACTUATOR

This application claims priority to provisional application No. 60/316,199, filed Aug. 31, 2001.

TECHNICAL FIELD

The invention relates generally to improvements in reciprocating linear actuators and methods for general use, including use in machines for handling a plurality of articles, particularly wrapping machines that have repeated cycles of article-handling operations.

BACKGROUND OF THE INVENTION

Machines, including wrapping machines, for handling a plurality of articles and having repeated cycles of article-handling operations require synchronization to be maintained between the multiple article-handling mechanisms cycle after cycle. Without synchronization, collisions would occur. Prior art wrapping machines use linked mechanical drives typically driven by a common motor. Synchronization was not perceived as a serious problem because all mechanisms were typically driven from the common motor. However, modern machines, mainly for cost and control flexibility reasons, are increasingly using servomotors. These servomotors usually drive mechanisms independently, often one per mechanism. This aggravates the synchronization problem. Important design considerations for wrapping machines that have repeated cycles of article-handling operations are synchronization, speed, durability and energy consumption.

SUMMARY OF THE INVENTION

A first embodiment of the present invention provides a reciprocating linear actuator comprising a frame, a servomotor mounted to the frame, a crank gear-coupled with integer gear ratio to the servomotor for unidirectional rotation, an actuator slide slideably-mounted to the frame for linear motion, and a connecting rod coupling the crank to the actuator slide. Preferably, the crank includes a crank arm with an outer end, and the connecting rod includes a driven end pivotally connected to the outer end, and a drive end pivotally connected to the actuator slide.

A first preferred embodiment of the present invention provides a digitally indexed reciprocating linear actuator, comprising a frame, a servomotor mounted to the frame, a crank gear-coupled with integer gear ratio to the servomotor for unidirectional rotation, an actuator slide mounted to the frame for linear motion, a connecting rod coupling the crank to the actuator slide, and means for detecting a selected non-home index position of the actuator slide. Preferably, the crank includes a crank arm with an outer end, and the connecting rod includes a driven end pivotally connected to the outer end, and a drive end. The actuator slide defines an index point. The means for detecting includes a sensor positioned to detect the index point. Preferably, the digitally indexed reciprocating linear actuator includes a toothed gear train having a gear ratio equal to a selected integer.

Another embodiment of the present invention provides a machine for handling a plurality of articles, the machine having repeated cycles of article-handling operations and a plurality of carriages, each carriage capable of carrying at least one article. This embodiment comprises a frame, a servomotor mounted to the frame, the servomotor having an angular position encoder, a crank gear-coupled with integer gear ratio to the servomotor for unidirectional rotation, an actuator slide slideably-mounted to the frame for moving a carriage in linear motion, a connecting rod coupling the crank to the actuator slide, and means for detecting a selected non-home index position of the actuator slide. Preferably, the machine includes means for interpolating encoder angular position values from a first and second detection of a non-home position of the slide to produce an angular position value corresponding to a home position of the slide. In one embodiment, the machine is a wrapping machine.

Another embodiment of the present invention provides a wrapping machine for wrapping a plurality of articles, the machine having repeated cycles of article-handling operations. The wrapping machine includes a plurality of carriages, each carriage capable of moving at least one article for wrapping, and at least one digitally indexed reciprocating linear actuator, coupled to move a carriage, the linear actuator having a crank and an actuator slide, the actuator slide having a non-home index point. The wrapping machine further includes means for recording first and second servomotor angular position values on detecting the index point at first and second angular positions of the crank, and means for identifying home position as an angular position value midway between the first and second position values.

The invention further provides a method for identifying a home position of the slide of a digitally indexed reciprocating linear actuator. The method requires a linear actuator including an actuator slide with an index point and a servomotor with an angular encoder. The method requires that the servomotor be configured for unidirectional rotation drive of the actuator slider via a crank, and that the crank be gear-coupled with integer gear ratio. The method comprises a) determining a first servomotor angular position value at a first detection of the index point, b) determining a second servomotor angular position value at a second detection of the index point, c) calculating a third servomotor angular position value midway between the first servomotor angular position and the second servomotor angular position; and d) identifying the third servomotor angular position value as a home position.

DETAILED DESCRIPTION OF THE INVENTION

Figure 1:
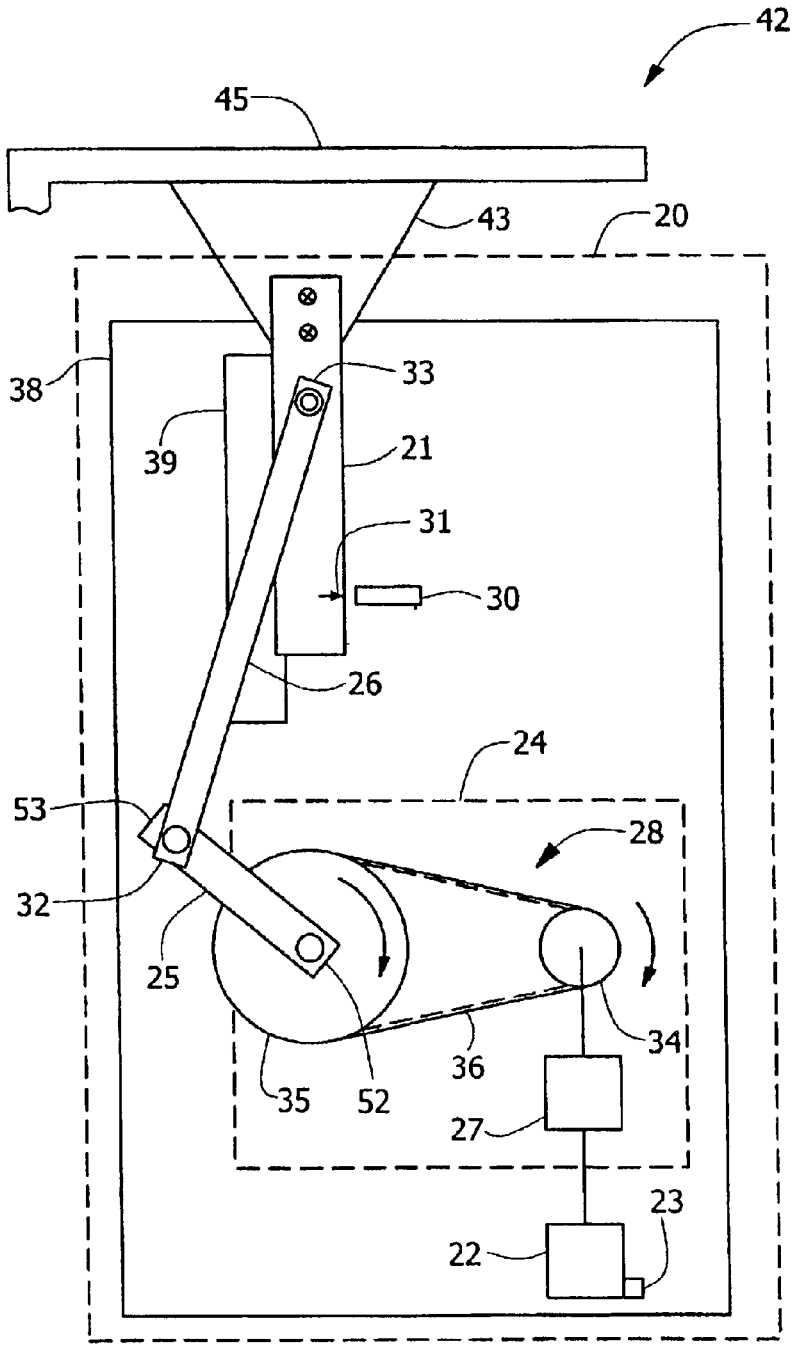
FIG. 1 is a schematic elevation view of a first preferred embodiment of a digitally indexed linear actuator in accordance with a first embodiment of the present invention.

Prior art servomotor-based drivers of reciprocating linear actuators typically use direct drive. In the direct-drive mode of operation, the servomotor rotates in one direction to advance the linear actuator and then rotates in the opposite direction to retract the linear actuator. Because of the need to reverse direction with every cycle of the linear actuator, such drivers suffer significant energy losses and significant limitations on machine speed. The present invention uses a servomotor running continuously in unidirectional mode to reduce energy consumption and to increase maximum machine speed.

In machines, such as wrapping machines, that handle a plurality of articles and have repeated cycles of article-handling operations, it is important to maintain synchronization between the multiple article-handling mechanisms cycle after cycle. Otherwise the articles or the mechanisms would collide with each other. Prior art wrapping machines use linked mechanical drives that automatically achieve synchronization because all mechanisms are driven by a common motor. However, these machines suffer from wear in cams, backlash in gears, and stretching in chains and belts. The use of independent servomotors for driving all mechanisms largely eliminates the wear, backlash and stretching problems. However, mechanisms driven by independent servomotors must be individually synchronized, preferably to a home position.

Synchronization to home (end of stroke) position of the slide of a reciprocating linear actuator presents a special problem in that it is difficult to detect home position directly using a motion detector or a proximity sensor with a high degree of precision. This is because linear motion of the actuator slide at the end of its stroke is zero, and linear motion of the actuator slide close to the end of stroke is very small. In the present invention this difficulty is overcome by using the high resolution of the output of a servomotor encoder output and interpolating two angular position values measured at points in the cycle of the reciprocating linear actuator where the linear motion of the slide is large. In a preferred embodiment, the method includes detecting the slide at one selected position, well removed from an end-of-stroke position, during an outward stroke and during an inward stroke, recording a servomotor encoder output value at each detection, and interpolating the two encoder output values to calculate encoder output value at home position.

It is, of course, necessary to establish an initial known position for every mechanism of the machine. This is accomplished during initialization of the machine by setting each servomotor angular position output to zero at home position.

To maintain synchrony through multiple cycles of the machine, the present invention uses a gear train that has an overall gear ratio of servomotor revolutions to crank arm revolutions that is a selected integer. This ensures that one full rotation of the crank arm corresponds to an integral number of full rotations of the servomotor, thereby allowing synchrony to be maintained from one cycle of the machine to the next through an unlimited number of cycles.

In a machine involving handling a plurality of articles and having repeated cycles of article-handling operations, the present invention provides a digitally indexed reciprocating linear actuator for synchronizing home position of a servomotor-driven actuator slide with angular position of the servomotor. The present invention provides an improved apparatus and method for synchronizing the multiple mechanisms of wrapping machines. In particular, the present invention provides an improved apparatus and method for precisely identifying the home position of a digitally indexed reciprocating linear actuator used to drive a carriage in a wrapping machine, the carriage carrying an item to be wrapped. The term "carriage" is used herein to include a "pusher" for moving an article horizontally, an "elevator" for moving an article vertically and a "linear translator" or like term for moving an article in any other direction. The apparatus and method provided by the present invention benefits machines having at least one carriage and having repeated cycles of operation. Benefits result from more precise synchronization of multiple mechanisms that handle a given article as it moves through the machine. Direct benefits include improvements in speed, durability or reliability of the machine. Indirect benefits include improvements in quality of the output product. In a wrapping machine indirect benefits include improvements in the quality of the package.

Figure 2A:
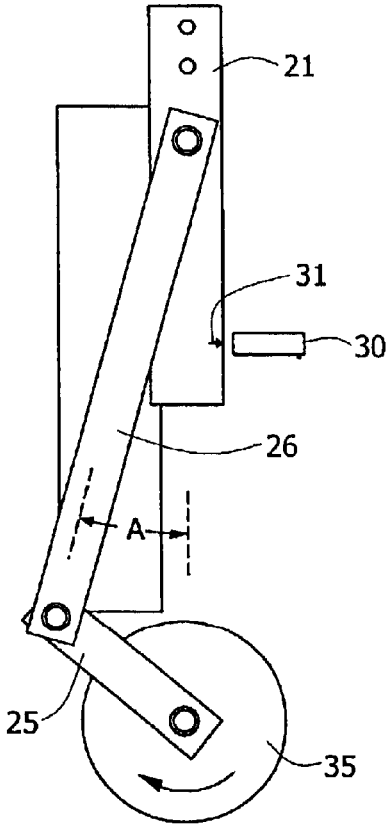
FIGS. 2A and 2B show a schematic elevation view of the embodiment of FIG. 1 with the crank arm at equal and opposite angular distances away from a home position.
Figure 2B:
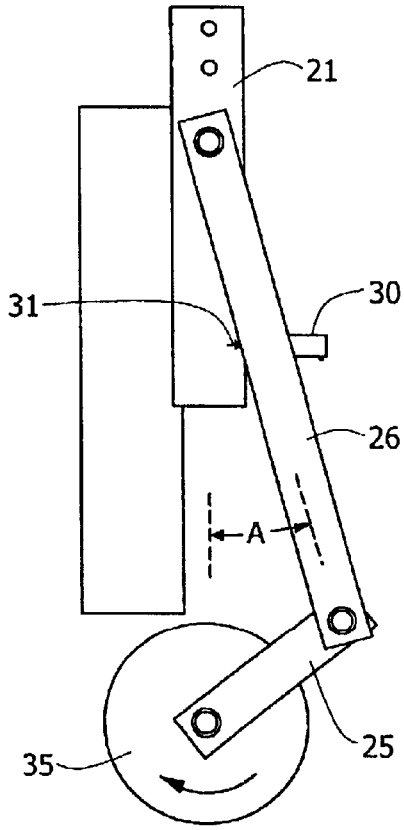

FIG. 1 shows a first preferred embodiment of a digitally indexed reciprocating linear actuator 20 having actuator slide 21. Slide 21 is driven by servomotor 22 operating in unidirectional rotation via gear train 24, crank arm 25 and connecting rod 26. Proximity sensor 30 is positioned to detect a selected position of the actuator slide. The selected position is shown as index point 31 in FIGS. 2A and 2B. FIGS. 2A and 2B show the proximity sensor detecting the selected position during both the outward stroke and the inward stroke of the actuator slide. Note that because what is being detected is the location of the selected point on its line of motion as the point moves with the actuator slide. The preferred embodiment of FIG. 1 uses a Siemens type 3R640-12-3AG01 proximity sensor. However, any type of proximity sensor or any other type of sensor capable of determining the location of the index point along its line of motion could be used, including a position sensor, a motion sensor, or even an optical alignment sensor located at a distance from the linear actuator and configured to detect a tiny index hole in the actuator slide.

In the preferred embodiment of FIG. 1, gear train 24 includes gearbox 27 and toothed belt drive 28. Belt drive 28 includes toothed drive wheel 34, toothed driven wheel 35, and toothed belt 36. Preferably, gearbox 27 and toothed belt drive 28 each have a gear ratio that is an integer. Driven wheel 35 turns crank arm 25 about its axis end 52. Outer end 53 of crank arm 25 is pivotally attached to driven end 32 of connecting rod 26. Actuator slide 21 is shown mounted for sliding motion on guide rail 39. Guide rail 39 is supported by frame 38. Drive end 33 of connecting rod 26 is pivotally attached to actuator slide 21. Actuator slide 21 is attached at its operative end to elevator mounting post 43 for reciprocating (raising and lowering) elevator plate 45.

Servomotor 22 includes position encoder 23 that generates angular position data corresponding to the current angular position of the servomotor.

Gear train 24 provides an overall gear ratio of motor revolutions to crank arm revolutions that is a selected integer. Because the gear ratio is an integer, a number of full rotations of the servomotor when the number equals the selected integral number, produces exactly one full rotation of the crank arm, so in subsequent rotations synchrony is maintained.

Suitably sized servomotors are preferably selected from the Allen Bradley® Ultra Series Servo drive family of servomotors. Control equipment is preferably selected from the AllenBradley® Control Logix PLC family.

FIGS. 2A and 2B are schematic elevation views of the embodiment of FIG. 1, showing the crank arm at equal and opposite angular distances "A" away from the angular position of the crank arm corresponding to the linear actuator being at its home position.

Figure 6:
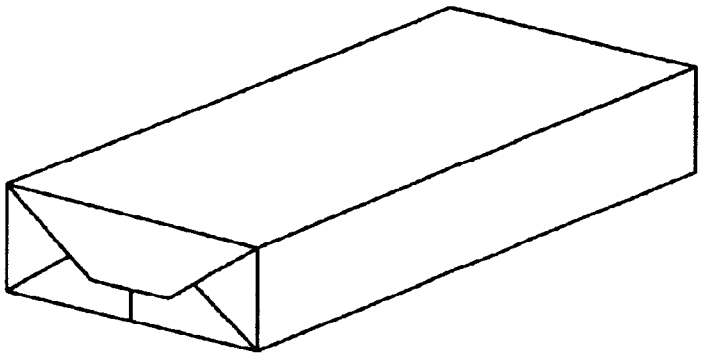
FIG. 6 PRIOR ART
FIG. 6 shows a standard (prior art) package that the novel wrapping machine of FIGS. 3–5 is capable of producing.

A standard (prior art) package produced by a wrapping machine is shown in FIG. 6. This standard package has a bottom long seam, glued or heat-sealed, and double point end-folds on both ends of the package.

Figure 7:
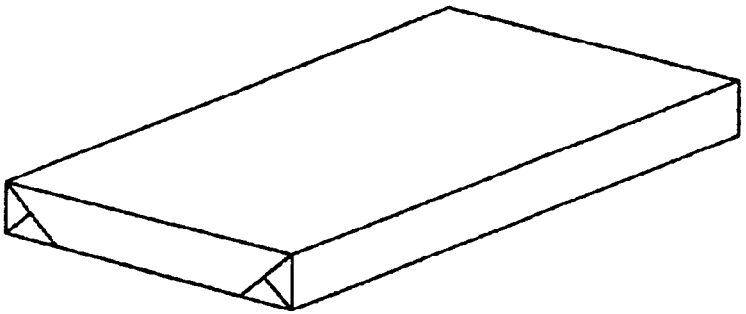
FIG. 7 PRIOR ART
FIG. 7 shows a reverse double point folds (prior art) package that the novel wrapping machine of FIGS. 3–5 is capable of producing.

A reverse double point folds (prior art) package produced by a wrapping machine is shown in FIG. 7.

Figure 3:
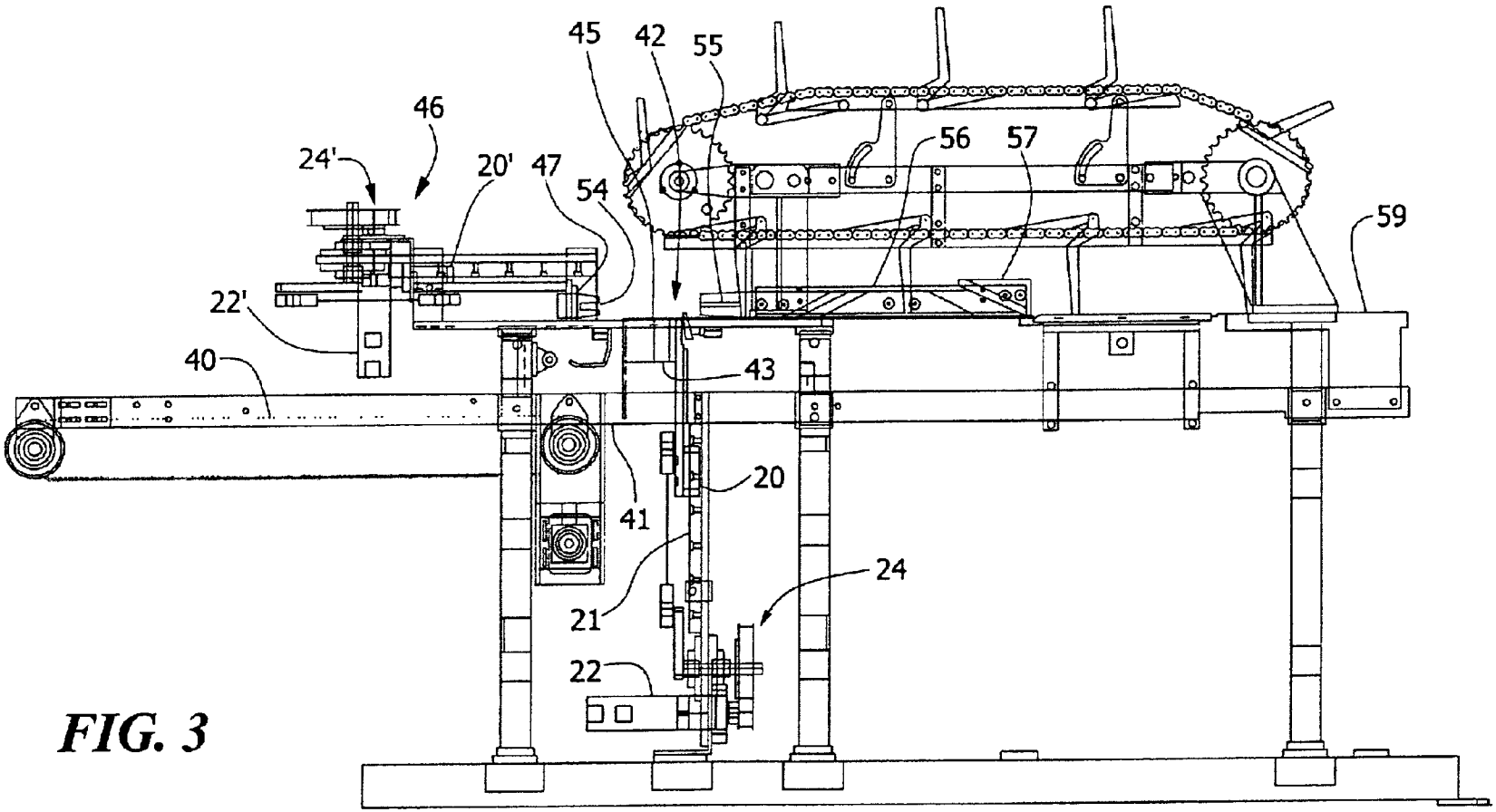
FIG. 3 is a schematic front elevation view of a novel wrapping machine that uses a digitally indexed linear actuator in accordance with the present invention, indicating the general location of several parts of the machine.

FIG. 3 is a schematic front elevation view of a novel wrapping machine that uses a digitally indexed linear actuator in accordance with the present invention. Preferably, the machine is 9–16 feet long, depending on the size range of packages to be wrapped. A machine according to the present invention can easily be sized to accommodate packages at least as large as 13.5×8×7 inches or at least as small as 2×1.125×0.375 inches. In a preferred embodiment, the machine will wrap up to 150 packages per minute in either paper or plastic, using trays or boxes.

FIG. 3 shows the general location of several parts of the machine and the location of the wrapper sheet with which the article is to be wrapped. Articles (not shown) are introduced to the machine via in-feed conveyor 40 and dead plate 41.

Elevator 42 lifts the article into a wrapper sheet (not shown) for wrapping. Elevator plate 45 is driven by servomotor 22, via gear train 24 and digitally indexed reciprocating linear actuator 20 (elevator actuator) in accordance with the present invention. Push bar 47 of pusher 46 removes articles one at a time from elevator plate 45 of elevator 42. Push bar 47 is driven by servomotor 22', via gear train 24' and digitally indexed reciprocating linear actuator 20' (pusher actuator) in accordance with the present invention.

Figure 8:
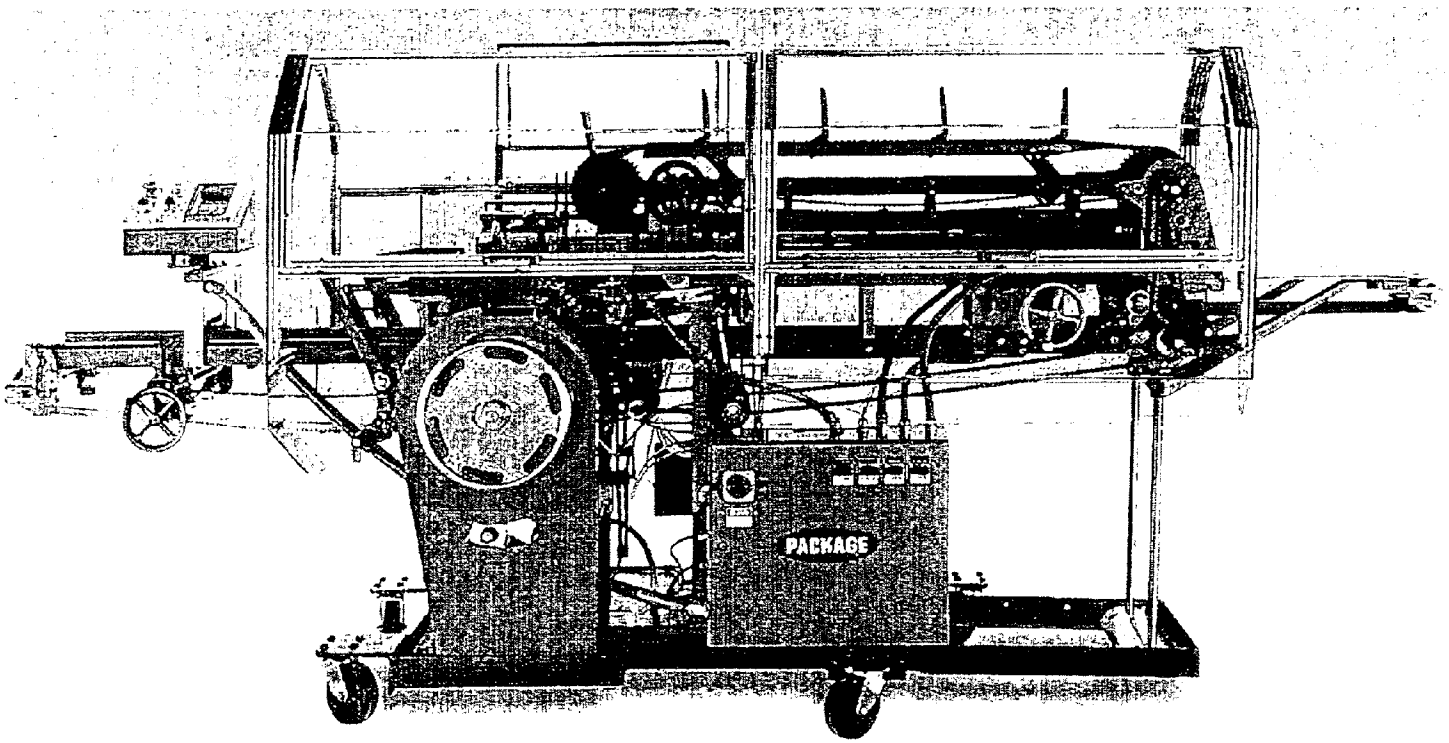
FIG. 8 PRIOR ART
FIG. 8 is an image illustrating the general appearance of a prior art wrapping machine manufactured by Package Machinery Company.

Folding of the wrapper sheet takes place at folding station 54 (tuckers), and at first, second, and third folding stations (folders) 55–57, respectively. Wrapped articles are carried out of the machine by out-feed conveyor 59. The steps of the folding process are substantially the same as the steps of the wrapping process of the prior art wrapping machine made by Package Machinery Company illustrated in FIG. 8. Such machines are widely used and the folding process is well known to those skilled in the art.

Figure 4:
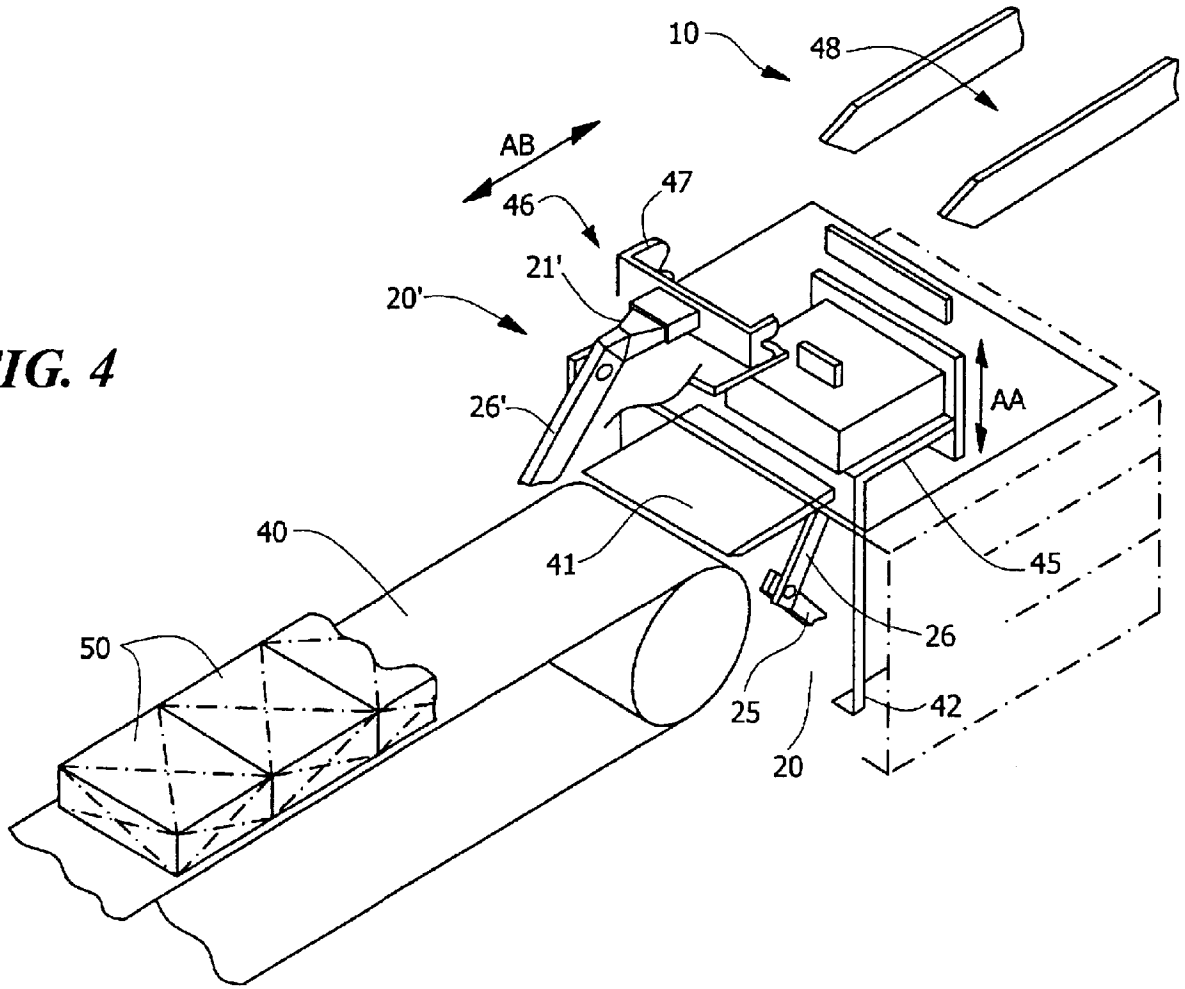
FIG. 4 is a perspective view of an in-feed elevator section of a wrapping machine using a digitally indexed linear actuator in accordance with the present invention.

FIG. 4 is a perspective view of a preferred embodiment of the in-feed region of the wrapping machine of FIG. 3. FIG. 4 shows in-feed conveyor 40 that frictionally advances a line of abutting articles 50, across a dead plate 41, to a wrapping machine 10. (Machine 10 is not explicitly shown but is represented in FIG. 4 by folding channel 48). Elevator plate 45 receives the leading article from conveyor 40 when it is on its lowest position. A first digitally indexed reciprocating linear actuator 20 raises elevator plate 45 to an upper discharge position. As this occurs, a pre-positioned wrapper sheet (indicated by 44 in FIG. 3) is partially folded about the article. (Digitally indexed reciprocating linear actuator 20 is shown in FIG. 1. It is represented in FIG. 4 only by crank arm 25 and connecting rod 26). The article is then advanced from elevator plate 45 through folding channel 48 to perform the operation of folding the wrapper sheet about the article. Elevator plate 45 is then lowered for a subsequent cycle of operation. Digitally indexed reciprocating linear actuator 20 reciprocates (raises and lowers) elevator plate 45 as indicated by arrows AA.

FIG. 4 also shows pusher 46 that includes push bar 47. Push bar 47 is driven by a second digitally indexed reciprocating linear actuator 20'. Pusher 46 moves articles from the upper discharge position through folding channel 48. Second digitally indexed reciprocating linear actuator 20' is similar to the first digitally indexed linear actuator shown in FIG. 1, except that it drives pusher 46 and push bar 47 horizontally. Digitally indexed reciprocating linear actuator 20' reciprocates (advances and retracts) push bar 47 horizontally as indicated by arrows AB. Digitally indexed reciprocating linear actuator 20' is represented in FIG. 4 only by connecting rod 26' and actuator slide 21'.

Both digitally indexed reciprocating linear actuators, 20 and 20', are synchronized, as discussed above, with respective servomotors, and all servomotors are synchronized with each other, thereby synchronizing actuators 20 and 20' with each other.

Except for the servomotors and the digitally indexed reciprocating linear actuators, what is illustrated in FIG. 4 is well known to those skilled in the art concerning wrapping machines. For example, see U.S. Pat. No. 3,243,033, to Merchant, et al, issued Mar. 29, 1966.

In the embodiment of FIG. 4, the common motor of the Merchant machine is replaced by a plurality of servomotors. More particularly, the elevator reciprocating mechanism and the pusher reciprocating mechanism of the Merchant machine are replaced by novel digitally indexed reciprocating linear actuators 20 and 20', respectively.

Figure 5:
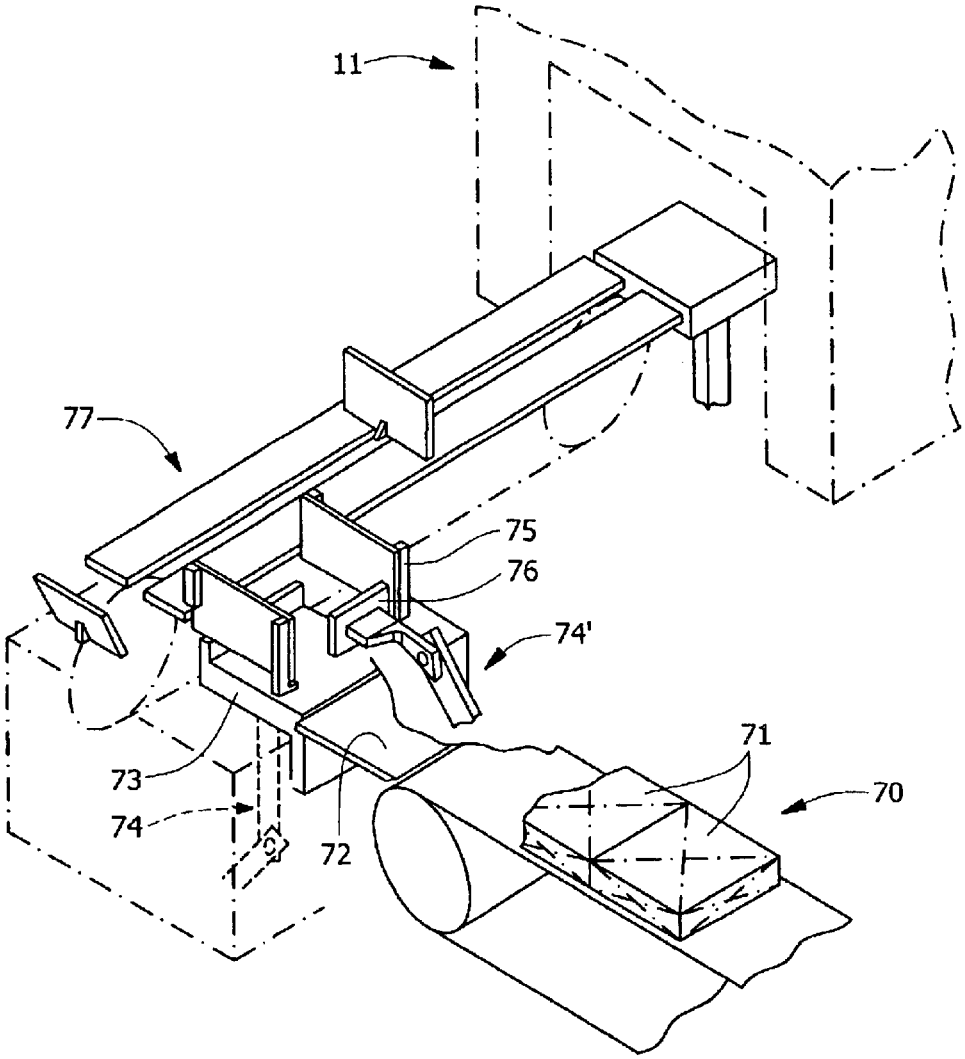
FIG. 5 is a perspective view of a stacking elevator section of a wrapping machine using a digitally indexed linear actuator in accordance with the present invention.

FIG. 5 is a perspective view of a preferred embodiment of a stacking elevator of a wrapping machine in accordance with the present invention.

FIG. 5 shows in-feed conveyor 70 advancing articles 71 across a dead plate 72 to elevator plate 73, which is reciprocated by first digitally indexed linear actuator 74' (similar to 20' shown in FIG. 1). Elevator plate 73 receives the leading article from conveyor 70 in its lower or receiving position and then raises that article to latches 75 in its upper or discharge position. Elevator plate 73 is then lowered to receive a next article from conveyor 70. Elevator plate 73 is then raised again to latches 75 to assemble a stack of articles thereon. Elevator plate 73 is raised and lowered by second digitally indexed linear actuator 74 (similar to 20 shown in FIG. 1).

After a predetermined number of cycles of elevator plate 73 (which determines the number of layers in the stack) the assembled stack is advanced by a pusher 76 to intermediate conveyor 77 which then advances the stack of articles to wrapping machine 11.

What is claimed is:

1. In a machine for handling a plurality of articles, the machine performing repeated cycles of a series of article-handling operations, the machine including a dedicated synchronized reciprocating linear actuator for each of several article handling operations, a digitally indexed reciprocating linear actuator, comprising:

a frame;

a servomotor mounted to said frame;

a crank gear-coupled with integer gear ratio to said servomotor for unidirectional rotation;

a dedicated actuator slide associated with a selected article-handling operation, the actuator slide slideably-mounted to said frame for linear motion; and a connecting rod coupling said crank to said actuator slide.

2. A digitally indexed reciprocating linear actuator according to claim 1, wherein said crank includes a crank arm with an outer end; and wherein said connecting rod includes a driven end pivotally connected to said outer end, and a drive end pivotally connected to said actuator slide.

3. A digitally indexed reciprocating linear actuator according to claim 1, further comprising:

means for producing first and second angular position values at first and second non-home index positions of said actuator slide; and means for interpolating first and second angular position values to produce an angular position value corresponding to a home position of said actuator slide.

4. A digitally indexed reciprocating linear actuator according to claim 1, wherein said crank is gear-coupled to said servomotor by a reduction gear train.

5. A digitally indexed reciprocating linear actuator, comprising:

a frame;

a servomotor mounted to said frame;

a crank gear-coupled with integer gear ratio to said servomotor for unidirectional rotation;

an actuator slide slideably-mounted to said frame for linear motion;

a connecting rod coupling said crank to said actuator slide; and means for detecting a selected non-home index position of said actuator slide;

wherein said actuator slide defines an index point; and wherein said means for detecting includes a sensor positioned to detect said index point.

6. A digitally indexed reciprocating linear actuator according to claim 5, wherein said crank includes a crank arm with an outer end; and wherein said connecting rod includes a driven end pivotally connected to said outer end, and a drive end pivotally connected to said actuator slide.

7. A digitally indexed reciprocating linear actuator according to claim 5, further comprising a toothed gear train having a gear ratio equal to a selected integer.

8. A machine for handling a plurality of articles, the machine having repeated cycles of article-handling operations and a plurality of carriages, each carriage capable of carrying at least one article, the machine comprising:

a frame;

a servomotor mounted to said frame, said servomotor having an angular position encoder;

a crank gear-coupled with integer gear ratio to said servomotor for unidirectional rotation;

an actuator slide slideably-mounted to said frame for moving a carnage in linear motion;

a connecting rod coupling said crank to said actuator slide;

means for detecting a selected non-home index position of said actuator slide; and means for interpolating encoder angular position values from a first and second detection of a non-home position of said slide to produce an annular position value corresponding to a home position of said actuator slide.

9. A machine according to claim 8, wherein said carriage is a pusher.

10. A machine according to claim 8, wherein said carriage is an elevator.

11. A machine according to claim 8, wherein said carriage is a stacking elevator.

12. A wrapping machine for wrapping a plurality of articles, the machine having repeated cycles of article-handling operations, the machine comprising:

a plurality of carriages, each carriage capable of moving at least one article for wrapping;

at least one digitally indexed reciprocating linear actuator, coupled to move a carriage, said at least one linear actuator having a crank and an actuator slide, said actuator slide having a non-home index point;

means for recording first and second servomotor angular position values on detecting the index point at first and second angular positions of the crank; and means for identifying home position as an angular position value midway between the lust and second position values.

13. A method for identifying a home position of the slide of a digitally indexed reciprocating linear actuator, the linear actuator having an actuator slide with a non-home index point and a servomotor with an angular encoder, said servomotor configured for unidirectional rotation of said actuator slide via a crank gear-coupled with integer gear ratio, the method comprising:

a. determining a first servomotor angular position value at a first detection of said index point;

b. determining a second servomotor angular position value at a second detection of said index point;

c. calculating a third servomotor angular position value midway between said first servomotor angular position value and said second servomotor angular position value; and d. identifying the third servomotor angular position value as a home position.

14. In a wrapping machine for wrapping a plurality of articles, the wrapping machine having a plurality of servomotor-driven reciprocating linear actuators, a method for synchronizing a reciprocating linear actuator, comprising:

a. providing a digitally indexed reciprocating linear actuator having an actuator slide with a non-home index point and a servomotor with an angular encoder, said servomotor configured for unidirectional rotation of said actuator slide via a crank gear-coupled with integer gear ratio;

b. determining a first servomotor angular position value at a first detection of said index point;

c. determining a second servomotor angular position value at a second detection of said index point;

d. calculating a third servomotor angular position value midway between said first servomotor angular position value and said second servomotor angular position value; and e. identifying the third servomotor angular position value as a home position.

15. A digitally indexed reciprocating linear actuator, comprising:

a frame;

a servomotor mounted to said frame;

a crank gear-coupled with integer gear ratio to said servomotor for unidirectional rotation;

an actuator slide slideably-mounted to said frame for linear motion;

a connecting rod coupling said crank to said actuator slide; and means for detecting a selected non-home index position of said actuator slide;

wherein said actuator slide has an associated index point coupled to said actuator slide for linear movement in concert with said actuator slide; and wherein said means for detecting includes a sensor positioned to detect said index point.

16. A wrapping machine for wrapping a plurality of articles, the machine having repeated cycles of article-handling operations, the machine comprising:

a plurality of carriages, each carriage capable of moving at least one article for wrapping;

at least one digitally indexed reciprocating linear actuator, coupled to move a carriage, said at least one linear actuator having a crank and an actuator slide, said actuator slide having a an associated non-home index point coupled to said actuator slide for linear movement in concert with said actuator slide;

means for recording first and second servomotor angular position values on detecting the index point at first and second angular positions of the crank; and means for identifying home position as an angular position value midway between the first and second position values.

17. A method for identifying a home position of the slide of a digitally indexed reciprocating linear actuator, the linear actuator having an actuator slide with an associated non-home index point coupled to said actuator slide for linear movement in concert with said actuator slide, and a servomotor with an angular encoder, said servomotor configured for unidirectional rotation of said actuator slide via a crank gear-coupled with integer gear ratio, the method comprising:

a. determining a first servomotor angular position value at a first detection of said index point;

b. determining a second servomotor angular position value at a second detection of said index point;

c. calculating a third servomotor angular position value midway between said first servomotor angular position value and said second servomotor angular position value; and d. identifying the third servomotor angular position value as a home position.

18. In a wrapping machine for wrapping a plurality of articles, the wrapping machine having a plurality of servomotor-driven reciprocating linear actuators, a method for synchronizing a reciprocating linear actuator, comprising:

a. providing a digitally indexed reciprocating linear actuator having an actuator slide with an associated non-home index point coupled to said actuator slide for linear movement in concert with said actuator slide, and a servomotor with an angular encoder, said servomotor configured for unidirectional rotation of said actuator slide via a crank gear-coupled with integer gear ratio;

b. determining a first servomotor angular position value at a first detection of said index point;

c. determining a second servomotor angular position value at a second detection of said index point;

d. calculating a third servomotor angular position value midway between said first servomotor angular position value and said second servomotor angular position value; and e. identifying the third servomotor angular position value as a home position.

* * * * *